United States Patent [19]

Spilhaus

[11] Patent Number: 4,520,572

[45] Date of Patent: Jun. 4, 1985

[54] GEOGRAPHICAL SUNDIAL

[76] Inventor: Athelstan Spilhaus, Box 1063, Middleburg, Va. 22117

[21] Appl. No.: 589,425

[22] Filed: Mar. 14, 1984

[51] Int. Cl.[3] ..... G04B 49/02

[52] U.S. Cl. ..... 33/270; 33/1 SA; 368/15; 434/288

[58] Field of Search ..... 33/269, 270, 1 SA; 434/111, 287, 288; 368/15, 62, 205

[56] References Cited

U.S. PATENT DOCUMENTS

| | | | |
|---|---|---|---|
| 89,585 | 5/1869 | Johnson | 33/270 |
| 358,957 | 3/1887 | Benson . | |
| 849,475 | 4/1907 | Hewitt . | |
| 1,674,161 | 6/1928 | de Bogory . | |
| 2,164,532 | 7/1939 | Leinert . | |
| 3,786,570 | 1/1974 | Davies | 33/270 |
| 4,387,999 | 6/1983 | Shelley | 33/270 |

*Primary Examiner*—William D. Martin, Jr.
*Attorney, Agent, or Firm*—Jones, Tullar & Cooper

[57] ABSTRACT

A sundial comprising a transparent hollow globe marked with latitude and longitude lines and including a map of the world is mounted on a stationary base. The globe is adjustable with respect to the base to enable the polar axis to be inclined toward a geographic pole of the earth and to permit alignment of a desired geographic location on the map with an index point. A reflector is mounted at the center of the globe and focuses an image of the sun onto the interior surface of the globe. The image traverses the globe as the earth rotates, thereby tracking the actual path of the sun with respect to the earth on the globe surface.

11 Claims, 6 Drawing Figures

GEOGRAPHICAL SUNDIAL

BACKGROUND OF THE INVENTION

The present invention relates, in general, to a device for tracking the path of the sun on a globe, and more particularly, to a sundial in the form of a globe, wherein the path of an image of the sun traverses the surface of the globe to provide an indication of the time of day and the month of the year.

The use of sundials of various forms to track the passage of time is an ancient art, and their use is well documented in early civilizations. Such devices still provide a fascination, and numerous designs have been produced over the years for displaying solar time. However, such devices do not readily show the location of the sun with respect to the surface of the earth during the course of a day, and thus do not present a graphic illustration of the progression of the sun. Thus, such devices do not provide a clear idea of the relative time at the location of the observer with respect to other parts of the earth.

Conventional sundials utilize a marker which casts a shadow onto the surface of a clock face, with the moving shadow providing an indication of the solar time at the location of the sundial. While such devices are useful, they do not help the observer to understand the relationship of various time zones around the earth, and thus have a limited educational value.

SUMMARY OF THE INVENTION

It is, therefore, an object of the present invention to overcome the limitations of prior art sundials by providing a sundial which shows the instantaneous geographic location of the sun at solar noon at any time during the course of a day.

It is another object of the invention to provide a sundial which graphically demonstrates the relative time of day in various parts of the earth.

It is a further object of the present invention to provide a device for tracking the path of the sun around the earth to demonstrate its motion not only during a given day, but through the seasons.

Briefly, the device of the present invention comprises apparatus for tracking the path of the sun on the surface of a globe. A transparent or translucent globe, marked with latitude and longitude lines and carrying a map of the world is mounted on a stationary base. The base is shaped to support the globe for rotation about the polar axis of the globe and to allow adjustment of the inclination of the axis. A suitable index marker is provided for allowing the observer to adjust the globe to correspond to his latitudinal and longitudinal position on the earth. The device further includes a support arm for positioning a reflector, such as a concave mirror, at the center of the globe.

In a preferred form, the support base for the globe includes a plurality of curved arms which define a socket adapted to receive the globe. The socket is of slightly larger diameter than that of the globe so that the globe can be moved in the socket. One of the arms preferably extends over the top of the globe when it is positioned in the socket, and carries the index marker. The base also is so arranged as to permit its alignment with the points of the compass and to permit the axis of the globe to be aligned with and inclined toward a pole of the earth, the south pole for a northern hemisphere sun dial, and the north pole for a southern hemisphere sun dial.

With the globe and the base properly positioned, the sun shines through the globe and its rays strike the concave mirror at the globe's center. The mirror focuses an image of the sun onto a small spot on the inside surface of the globe. This spot indicates the actual overhead (noon) location of the sun on the earth at that instant of time. The image traverses the globe during the course of the day, and will cross the longitudinal line, or meridian, where the observer is located at true solar noon for that location. Ante-meridian (am) and post-meridian (pm) times can be calculated from the distance of the sun's image from the longitude of the observer. Preferrably, the longitudinal lines on the globe are spaced by 15°, which is the distance the sun travels in one hour, so that they can be used to determine the time of day.

Thus, the present invention provides a unique sundial which permits easy determination of true solar time. In addition, the device provides a unique educational function by illustrating the path followed by the sun around the earth during the course of a day.

BRIEF DESCRIPTION OF THE DRAWINGS

The foregoing and additional objects, features and advantages of the present invention will become apparent to those of skill in the art from a consideration of a detailed description thereof taken in conjunction with the accompanying drawings, in which.

DESCRIPTION OF PREFERRED EMBODIMENTS

Figure 1:
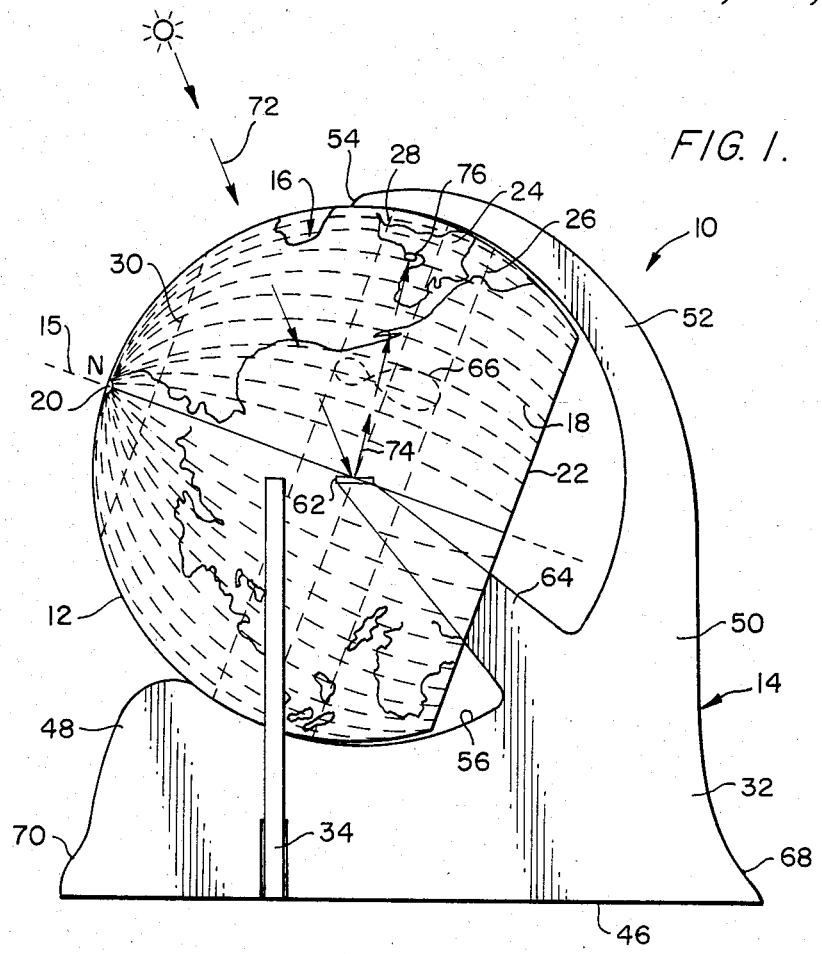
FIG. 1 is a side elevation view of a northern hemisphere sundial in accordance with the present invention.

Turning now to a more detailed consideration of the present invention there is illustrated at 10 in FIG. 1 a sundial which includes a globe 12 supported in and rotatably carried by a base 14. As illustrated in FIG. 1, the globe 12 consists of a transparent, hollow sphere having a polar axis 15 which is the diameter of the globe that defines the location of the north and south poles for a map of the world which is carried on the globe. The map, generally indicated at 16, may be printed or otherwise affixed to either the interior or exterior surfaces of the globe, or may be embedded in the globe wall. A preferred method of marking the map is to etch the outline of the map on the interior surface of the globe so that it is visible from the exterior through the transparent material. A suitable plastic such as acrylic may be used to form the globe.

Also marked on the globe, again either on the interior or exterior surface thereof, are a plurality of lines 18 marking the longitude of various locations on the globe. The longitude lines 18 preferrably are spaced no more than 15° apart, and extend from the north pole 20 to the south pole (not shown) in conventional manner. The southern portion of the globe is cut away as at section line 22 to provide an opening in the region of the south pole of the globe to accommodate the base 14, as will be described hereinafter, thereby to permit rotational motion of the globe on its base.

The globe also carries latitude lines, although for clarity only the lines marking the equator 24, the tropic of capricorn 26, the tropic of cancer 28 and the arctic circle 30 are shown in the drawings. These markings are conventional, of course, and for this reason are shown diagrammatically in the figures.

Figure 2:
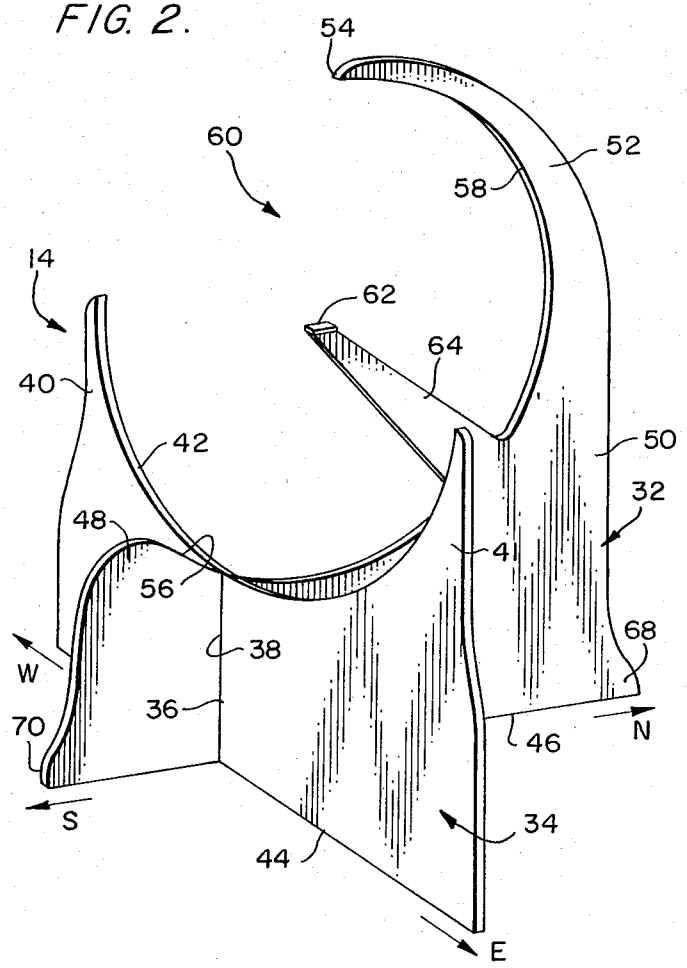
FIG. 2 is a perspective view of one form of the base for the sundial of FIG. 1.
Figure 3:
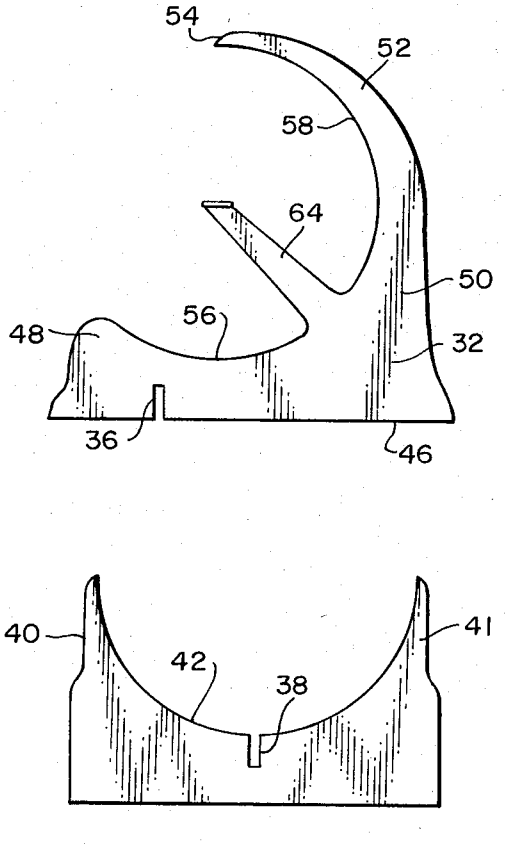
FIG. 3 illustrates an unassembled view of the base of FIG. 2.

The base 14 is illustrated in its assembled form in FIG. 2 and in its unassembled form in FIG. 3, FIG. 3 being reduced in size. The base may be constructed of plastic, wood, metal, or other suitable material, and includes a first member 32 and a second member 34 assembled by means of interlocking slots 36 and 38, respectively, so that they extend at right angles to each other, as shown in FIG. 2. The base members 32 and 34 preferrably are formed from relatively thin, stiff sheets, with member 34 including a pair of upwardly extending support arms 40 and 41 which define a curved support surface 42 adapted to receive the outer surface of globe 12. Since the base member 34 does not lie in a plane which passes through the center of globe 12, as illustrated in FIG. 1, the curve 42 follows an arc of a circle having a radius slightly less than the radius of the outer surface of globe 12 so that the globe rests snugly in the arms 40 and 41 while being easily rotatable. The flat bottom 44 of the base member 34 is adapted to rest on a suitable support surface such as a table and is flush with the bottom surface 46 of the base member 32 when the base is assembled.

The base member 32 also includes a pair of upwardly extending support arms 48 and 50, but in this case an extension 52 of the support arm 50 extends upwardly and over the globe 12 in the manner illustrated in FIG. 1 to define an index arm. The index arm 52 carries at its distal end a suitable marker 54 which may be the end of the arm itself shaped to a fine point, or may be a transparent, flattened portion carrying cross hairs or other suitable index markings.

The curvature of surface 56 of the member 32 has a radius that is the same as, or is slightly larger than, the radius of globe 12. In the preferred form of the invention, the inner surface 58 of the index arm 52 has the same radius as the curvature of surface 56 so that the globe fits snugly into the curvature of base 32 as defined by surfaces 56 and 58 and is supported thereby as illustrated in FIG. 1. When the base is assembled, members 32 and 34 lie in vertical planes which intersect at right angles, with the curved surfaces 42, 56 and 58 defining, with arms 40, 41, 48, 50 and 52, a socket for receiving and securely supporting the globe 12.

The vertical index arm 52 acts as a guide for aligning the globe within the socket so that the polar axis 15 lies in the plane of base member 32. This is accomplished by aligning the index arm 52 with one of the longitude lines 18 on the globe.

The globe 12 may be rotated about its axis 15 when in position with socket 60. In addition, the globe may be pivoted in the socket to permit adjustment of the angle of inclination of polar axis 15 with respect to the horizon. This rotational and pivotal motion allows the globe to be adjusted within the socket to position any desired latitude and longitude at the index point 54, thereby allowing, for example, the exact latitudinal and longitudinal position of the observer to be positioned at the index marker. The base members 32 and 34 provide a stable support for the globe and hold it sufficiently tightly to insure that it will remain in position once aligned, while still permitting easy adjustment.

Figure 4:
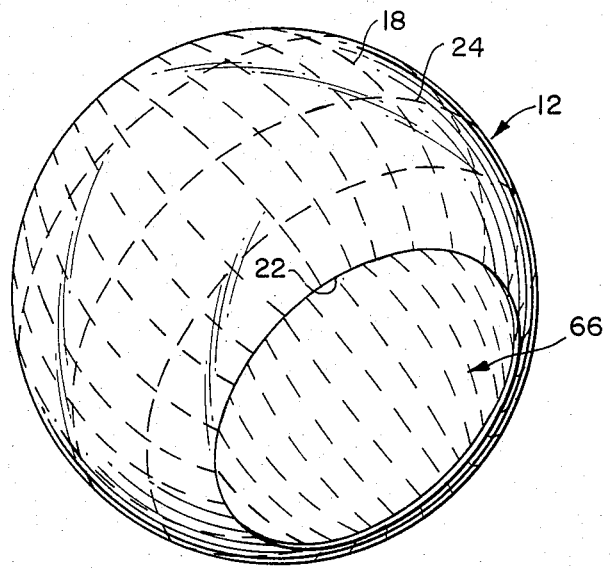
FIG. 4 is a bottom perspective view of the globe used in the sundial of FIG. 1.

A reflector such as a flat or slightly concave mirror 62 is positioned with its center at the center of globe 12, and thus along the polar axis 15. The index arm 52 extends sufficiently far over the globe to position the index marker 54 vertically above the center of mirror 62. In the preferred form of the invention, the mirror is supported at this central location by means of a reflector support arm 64 which extends from and forms a part of base member 32. The arm 64 extends into the center of the hollow globe 12 through the aperture 66, illustrated in FIG. 4, which is defined by section line 22. The aperture 66 is sufficiently large and the location of arm 64 is selected to allow full range of motion of the globe when it is pivoted to adjust the inclination of axis 15. The base of arm 64 intersects the curved surface 56 at a location selected to allow free pivotal motion of the globe, with the arm preferrably extending at an angle of about 45° from the horizontal.

The reflector 62 preferrably is a mirror about $\frac{1}{4}''$ square and either flat or slightly concave to have a focal length approximating the radius of the globe. This mirror may be formed, for example, by shaping a concavity in the top end of arm 64, and silvering the shaped surface. Alternatively, the reflector may be adhesively secured to the end of arm 64, and may include a suitable lens with a mirrored surface on its back side. The reflector is designed to reflect incoming light from the sun to produce a small image, or spot, on the interior surface of the globe, with the exact size of the image produced depending upon the dimensions of the globe and the curvature of the reflector.

Figure 5:
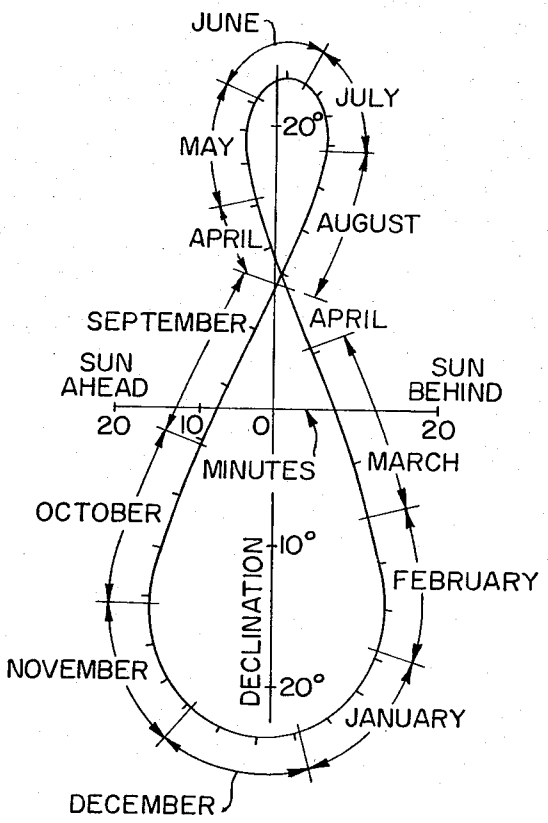
FIG. 5 is a conventional analemma diagram which may be used for calculating the correct clock time from the solar time indicated on the sundial.

If desired, an analemma 66 of the type illustrated in FIG. 5 may be incorporated in the markings on the surface of globe 12. The analemma permits accurate determination of local time by taking into account variations in the earth's orbit, and thus in the apparent motion of the sun during the course of a year, in known manner.

The sundial 10 is set up for use by aligning the base so that base member 32 lies in a north-south plane, with the right hand end 68 (as viewed in FIG. 1) pointing north and the opposite end 70 pointing south. The base member 32 must be aligned with the true geographic north-south line; if a magnetic compass is used in setting up the sundial, corrections must be made for declination. With the sundial resting on a horizontal surface, and with the base lying in a north-south plane, the globe 12 is then rotated within the socket 60 to position the longitudinal line, or meridian, of the observer under the index marker 54 and thus under the index arm 52. The globe is then pivoted within socket 60 to adjust the inclination of polar axis 15 with respect to the horizontal so as to bring the latitude of the observer also into alignment with index point 54. The globe is accurately positioned when the local latitude and longitude point is directly under the index marker 54 and when the plane of the local meridian, which plane passes through the center of the globe, is vertical. In the illustrated embodiment, this results in the plane of the meridian also lying in the plane of the base member 32 and of the index arm 52, with the polar axis 15 and the north pole 20 of the globe being inclined toward the south.

With the sundial positioned as described, parallel rays, generally indicated by the arrows 72 in FIG. 1, from the sun will pass through the transparent globe and will be reflected from the centrally located reflector 62. The reflector focuses an image of the sun onto the interior surface of the globe at a location within the equatorial regions between the tropics of cancer and capricorn, as indicated by arrows 74 and image 76. The exact location of image 76 will depend upon the angle of incidence of the rays 72 and will change throughout the day, as the earth rotates with respect to the sun. Throughout the day the image 76 traverses the world map from sunrise to sunset and shows at a glance where on the earth the sun is directly overhead (i.e., the location of solar noon) at that instant of time.

The primary longitude lines 18 marked on the globe are spaced 15° apart, and the image of the sun moves from one meridian to the next, 15° to the west, in one hour. Intermediate intervals of longitude may also be marked to provide more accurate readings. When the sundial is adjusted for local latitude and longitude, as described above, it shows the true local solar noon when the image of the sun is on the local meridian marked by the index marker 54. If the image of the sun is east of that meridian, the time is one hour earlier than noon for each 15° segment; in other words, it is am (ante-meridian). If the image is to the west of the local meridian, it is one hour after noon, or pm (post-meridian) for each 15° segment.

Because the earth's axis is inclined 23½° to the plane of the ecliptic, the plane in which the earth revolves around the sun, the sun does not remain directly overhead at the equator. In mid summer, the sun is overhead at the tropic of cancer, 23½° north latitude. Then it moves south and crosses the equator at the autumnal equinox, and in mid winter is directly overhead at the tropic of capricorn, 23½° south latitude. Accordingly, the tracing followed by the image 76 will shift between the tropics 28 and 26, and from the position of this image above or below the equator, the approximate date can be established through the use of analemma 66. Thus, the sundial is also a calendar.

Clocks, watches and other time pieces measure mean solar time; that is, they record all days of the year as being the same length. But because the earth moves in an elliptical path around the sun, the time interval between successive solar noons, as measured by a clock, varies throughout the year by as much as 16 minutes one way or another. This difference is called the equation of time and is also illustrated on the analemma 66 (FIG. 5) for the various months. This allows an accurate determination of clock time from the position of the image 76.

In using any sundial, it is also necessary to correct for the standard time zones such as eastern standard time, central standard time, etc. Thus, persons at opposite edges of time zones will experience solar noon either before or after noon as recorded by clock time, and adjustments may be made to accommodate such variations.

The sundial as illustrated is universal for the northern and southern hemispheres, except that the globe is reversed and the cut away portion 22 is at the north pole for use in the southern hemisphere. The globe can be set for the exact latitude and longitude where it is to be located and will provide an accurate tracing of the path of the sun each day, providing a graphic illustration as the spot 76 moves from east to west of the change in the location where the sun is directly overhead on the earth during the course of the day. The mirror located at the center of the globe gives a reversal of the sun's motion so that the spot 76 travels on the map in the correct direction. This association of the moving image with the map as well as with the longitude and latitude lines provides a graphic illustration of the apparent motion of the sun and of the relationship of the sun's position to various geographic locations on the earth. Accordingly, the sundial not only provides the time of day, but also is a useful educational tool.

Figure 6:
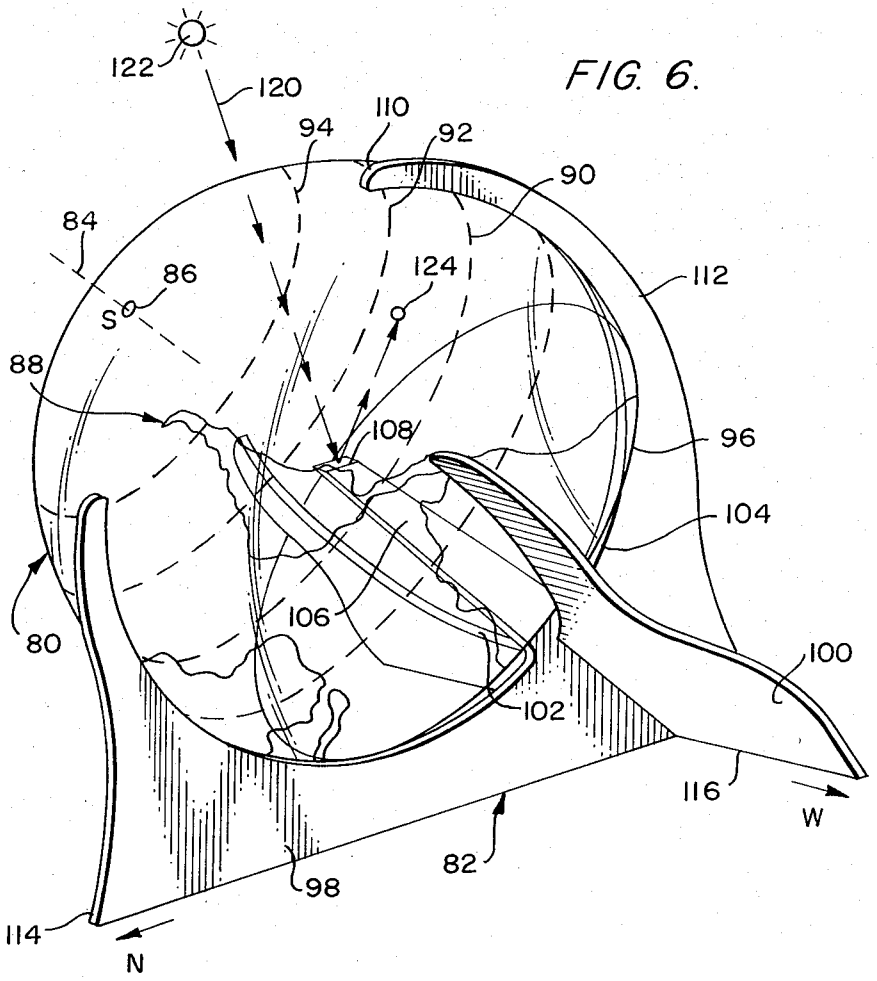
FIG. 6 is a diagrammatic perspective view of a southern hemisphere sundial using a modified form of base.

The southern hemisphere sundial is illustrated in FIG. 6, which also shows a modified form of the base. Thus, FIG. 6 shows a transparent, hollow globe 80 supported in a base 82, the globe having a polar axis 84 which defines the location of the south pole 86 on the globe. As in the prior embodiment of the invention, the globe includes a map 88, suitable latitude lines such as equator 90, tropic of capricorn 92 and antarctic circle 94, and suitable longitude lines (not shown). In this embodiment, the northern hemisphere is cut away at section line 96.

The base 82 includes base members 98 and 100, which are substantially the same as base members 32 and 34, described above. However, in this embodiment, element 100 intersects element 98 at about a 45° angle, so that the plane of element 100 passes through the center of globe 80. Accordingly, the upper curved surface 102 of the member 100 has substantially the same radius of curvature as the upper surface 104 of base member 98; that is, a radius substantially the same as the radius of globe 80. This facilitates manufacture of the base, and provides improved stability for the sundial.

The base 82 includes a reflector support arm 106 which extends from member 98 into the center of globe 80, through the polar opening defined by section line 96, in the manner described hereinabove for support arm 64. The upper end 108 of support arm 106 is concave and coated with a suitable highly reflective material to form a concave mirror for reflecting and focusing light from the sun onto the inner surface of globe 80.

The base 82 forms a socket for receiving the globe, so that the globe may be adjusted with respect to an index marker 110 carried by an index arm 112 which is a part of the base member 98. The base member 98 is aligned in the north-south plane, with the end 114 of the base which supports the south pole (in this example) facing north, and the bottom 116 of the base member 100, which is at right angles to base member 98, is aligned in an east-west plane. The globe is adjusted to align the index marker 110 with the latitude and longitude of the observer in the southern hemisphere, with the longitude line of the observer lying in a vertical plane which passes through the center of the globe. The polar axis 84 is then inclined toward the north pole of the earth, and the sundial operates in the manner previously described to reflect rays 120 from the sun 122 onto the surface of the globe, as at 124.

Although less desirable, a sundial globe usable in both the northern and southern hemispheres may be provided by removing segments of the globe at both the north pole and the south pole. This would allow the globe to be supported on base 14 or base 82 with either end of the polar axis extending away from the base. The globe would then have the general shape of a torus.

Although the present invention has been illustrated in terms of preferred embodiments, it will be apparent that additional variations and modifications may be made.

For example, it may be desired to support the globe internally, on a base that contacts the interior surface of the globe to support it for rotational and pivotal motion, instead of utilizing the exterior support illustrated. Such a support arrangement may utilize, for example, a plurality of radially extending arms mounted on a base and extending through the opening 66, the arms engaging the interior surface of the globe to permit rotation and adjustment of the angle of inclination. Such a mounting arrangement would not, however, affect the basic arrangement of the present invention, which incorporates an interior reflector and an index marker located vertically thereabove for adjusting the globe to the local latitude and longitude. Accordingly, the true spirit and scope of the present invention is to be limited only by the accompanying claims.

What is claimed is:

1. A sundial comprising a transparent, hollow globe having a polar axis and having latitude and longitude markings;

a base for rotatably supporting said globe with said polar axis inclined toward the geographic south pole of the earth;

index means secured to said base, said globe being rotatable with respect to said index means to position a selected latitude and longitude on the surface of said globe at said index means;

reflector means; and support means mounted on said base and supporting said reflector means, said support means locating said reflector means on said polar axis and at the center of said globe for reflecting an image of sunlight entering said globe to a location on said globe which corresponds to solar noon.

2. The sundial of claim 1, wherein said base is stationary and includes a plurality of curved arms which cooperate with said index arm to define a socket for receiving said globe.

3. The sundial of claim 2, wherein said base arms extend under said globe and said index arm comprises a curved arm extending over a portion of the top of said globe, said base arms and index arm securing said globe in said base.

4. The sundial of claim 3, wherein said support means for said reflector means comprises a support arm extending into the interior of said globe.

5. The sundial of claim 4, wherein said globe includes an opening for accommodating said support arm, said opening being sufficiently large to permit rotation of said globe about its polar axis and to permit adjustment of the angle of inclination of said polar axis with respect to said base.

6. The sundial of claim 1, wherein said reflector means comprises a concave mirror having a focal length approximately equal to the radius of said globe.

7. The sundial of claim 1, wherein said index means comprises an index arm extending over said globe, and an index marker on said index arm.

8. The sundial of claim 7, wherein said index marker is located at the end of said index arm, said arm being sufficiently long to position said index marker vertically over said reflector means.

9. Apparatus for tracking the path of the sun on the surface of a globe, comprising:

a base;

a transparent, hollow globe adjustably supported on said base, said globe having a polar axis and carrying latitude and longitude markings;

reflector means;

support means for said reflector means, said support means locating said reflector means along said polar axis and at the center of said globe for reflecting an image of sunlight entering said globe having a latitude and longitude corresponding to the instantaneous solar noon, said image traversing the surface of the globe in accordance with the earth's rotation, whereby the path traversed by the sun at true solar noon on the earth is imaged on said globe.

10. The apparatus of claim 9, wherein said base includes means for inclining the polar axis of said globe toward a geographic pole of the earth.

11. The apparatus of claim 10, further including index means mounted on said base, said globe being adjustable with respect to said base and said index means to permit predetermined globe latitude and longitude markings to be aligned with said index means while maintaining the inclination of said polar axis toward said geographic pole.

* * * * *